US005435223A

United States Patent [19]

Blodgett et al.

[11] Patent Number: 5,435,223

[45] Date of Patent: Jul. 25, 1995

[54] CARTRIDGE PRIMING DEVICE WITH SAFETY GUARD

[75] Inventors: Fred B. Blodgett, Chico; Steven R. Shields; Alan D. Schufeldt, both of Oroville, all of Calif.

[73] Assignee: Blount, Inc.

[21] Appl. No.: 198,529

[22] Filed: Feb. 17, 1994

[51] Int. Cl.[6] ..... F42B 33/04

[52] U.S. Cl. ..... 86/38

[58] Field of Search ..... 86/38, 37, 36, 24, 23

[56] References Cited

U.S. PATENT DOCUMENTS

| | | | |
|---|---|---|---|
| 374,482 | 12/1887 | Lee | 86/38 |
| 3,555,959 | 1/1991 | Lee | 86/37 |
| 3,636,812 | 2/1972 | Nuler | 86/37 |
| 4,222,305 | 9/1980 | Lee | 86/37 |
| 4,429,610 | 2/1984 | Mantel | 86/24 |
| 4,542,677 | 9/1985 | Lee | 86/38 |
| 4,620,472 | 11/1986 | Dillon | 86/38 |

*Primary Examiner*—Charles T. Jordan
*Attorney, Agent, or Firm*—Klarquist, Sparkman, Campbell, Leigh & Whinston

[57] ABSTRACT

A cartridge priming device having a cartridge receiver for holding a cartridge to have a primer inserted therein, a primer receiving station for holding a single primer for insertion into a cartridge, a primer reservoir operable to hold a plurality of primers, a passage for directing primers from the reservoir to the primer receiving station, and a guard shiftable between a first position, allowing primers to pass from the passage into the primer receiving station, and a second position in which the guard isolates the primer receiving station from the primer passage to shield following primers from a primer in the primer receiving station. The tool may be a hand-held and operated tool having a swingable handle, with the guard being an arcuate plate member connected to and movable with the operator handle between its first and second positions.

27 Claims, 3 Drawing Sheets

CARTRIDGE PRIMING DEVICE WITH SAFETY GUARD

FIELD OF THE INVENTION

The present invention relates to a tool for inserting primers into ammunition cartridge cases, and more particularly to such a tool in which a guard shields a primer ready for insertion from additional primers being fed to the tool.

SUMMARY OF THE INVENTION

Many gun sportsman load their own ammunition. This allows them to reduce their cost of shooting and to customize their ammunition by selective loading procedures which they adopt.

One of the operations included in reloading ammunition is the step of pressing a primer into the primer receiving port in the head, or base, of a cartridge case. Apparatus is generally known for performing this operation. Such apparatus often includes means for holding a cartridge case in a selected position, positioning a new primer adjacent the primer port in the case, and with plunger mechanism pressing the primer into the primer port of the cartridge case.

For the sake of efficiency, such apparatus often includes a reservoir operable to hold a plurality of primers which are fed in line to a primer receiving station to await pressing into the cartridge case.

A potential risk of injury and damage is inherent in such apparatus. If a primer becomes pinched or otherwise impinged upon it could be activated, or fired, in the apparatus. With primers following in-line from the reservoir to the primer station the activation, or firing, of the primer in the primer station will cause a migration of firing to adjacent primers traveling into the reservoir which can produce damage to equipment and potential injury to the operator.

In the past, various devices have been designed to try to overcome this problem of migration of firing from the single primer in the priming station. However, such prior attempts generally have produced complex, unwieldy and expensive apparatus. Not only have they been complex and expensive, but they may substantially slow the operation of the apparatus.

Prior devices, also have been inapplicable for use in hand-held priming tools. Hand-held priming tools generally are of a size to be held in and permit operation by one hand. Attempts to incorporate previously-known safety devices with a hand-held primer insertion tool would produce a less than desirable device, which would be more complex, heavier and more expensive than is generally desired by the user of a hand-held tool.

An object of the present invention is to provide a novel tool for inserting primers into a cartridge which includes a simple, inexpensive, and effective guard, or shield, to inhibit migration of the activation, or firing, from one primer positioned for insertion into a cartridge case to adjacent primers in the system.

More specifically, an object of the invention is to provide a novel tool which incorporates a sliding member which is shiftable between a first position which permits a primer to move from a primer supply passage to a primer receiving station, and then upon operation of the device to a second position intermediate the primer supply passage and primer receiving station to provide a shield therebetween.

Yet another object of the present invention is to provide a novel guard, or shield, for isolating a primer at a primer receiving station of a hand-held priming tool which incorporates an elongate member operatively connected to an operating handle for the tool with the guard being shiftable between shielding and passing positions upon operation of the handle for the tool.

These and other objects and advantages will become more apparent as the following description is read in conjunction with the drawings.

DESCRIPTION OF PREFERRED EMBODIMENT

Figure 1:
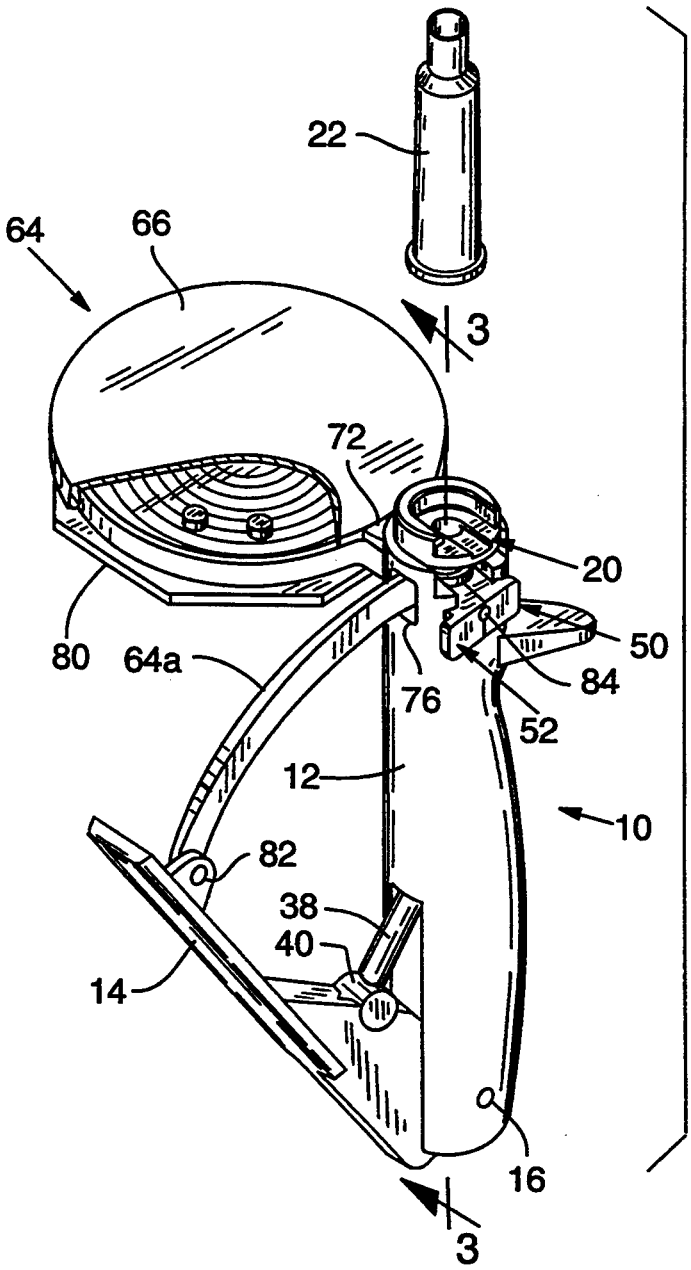
FIG. 1 is a perspective view of a tool according to an embodiment of the present invention ready to receive a cartridge case into which a primer is to be inserted.
Figure 2:
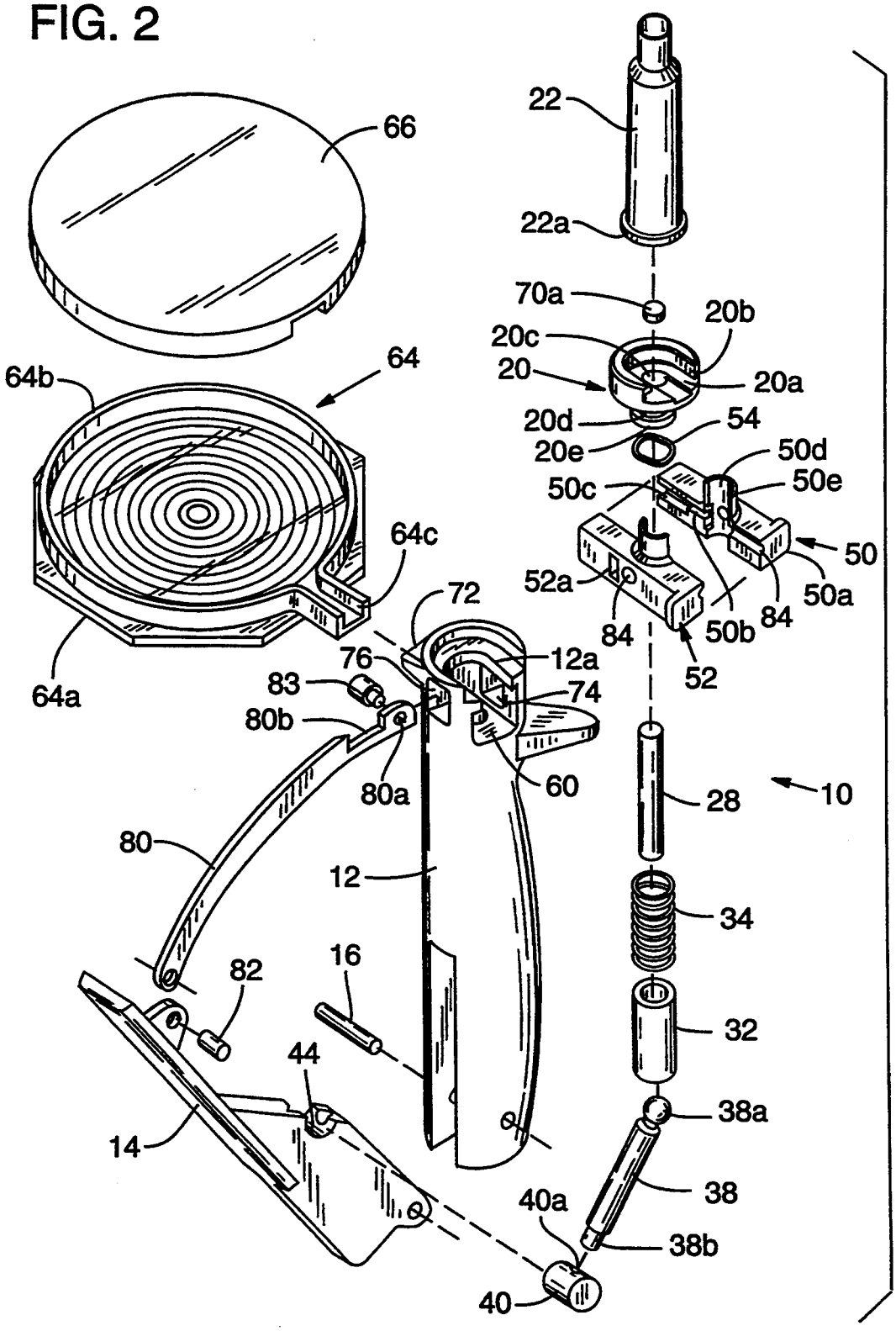
FIG. 2 is an exploded perspective view of the tool shown in FIG. 1.

Referring to the drawings, and first more particularly to FIGS. 1 and 2, at 10 is indicated generally a tool constructed according to a preferred embodiment of the present invention. The tool includes an elongate body 12 to which an elongate operating handle 14 is pivotally connected adjacent its lower end by a pivot pin 16.

Body 12 has mounted at its upper end a cartridge case receiver 20 which receives and holds the base of a cartridge case. The cartridge case has a projecting rim **22*a* at its base and a primer receiving port 22*b* (see FIG. 4**) into which a primer is to be inserted by the tool.

The cartridge case receiver has a slot **20*a* opening to one side producing a U-shaped lip 20*b* adapted to hold the projecting rim 22*a* of the cartridge case. A bore 20*c* extends vertically through case receiver 20. Case receiver 20 also has a depending neck 20*d* from the lower end of which projects a circular flange 20*e***.

The tool body 12 has a U-shaped inwardly projecting lip **12*a*. Neck 20*d* of the case receiver fits within lip 12*a* and flange 20*e*** rests against the underside of the lip upon assembly.

Figure 3:
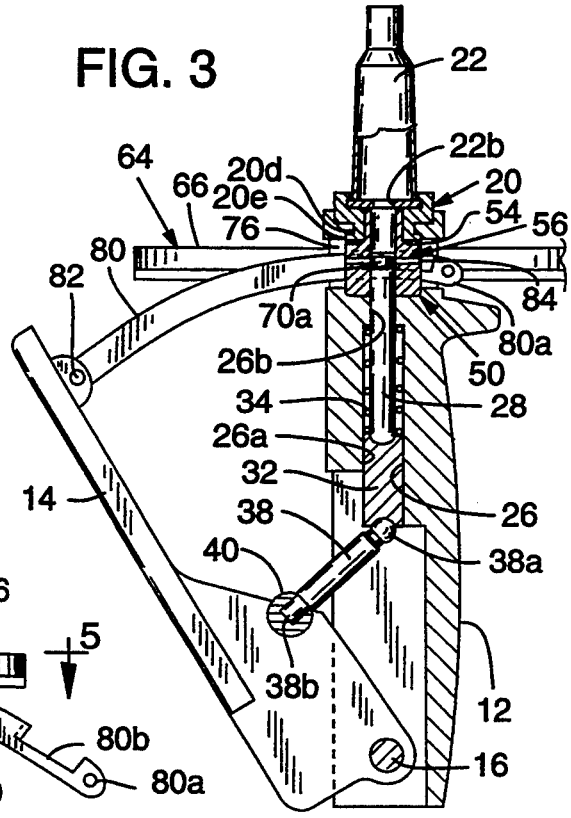
FIG. 3 is a cross-sectional view of the tool taken along the line 3—3 in FIG. 1.
Figure 4:
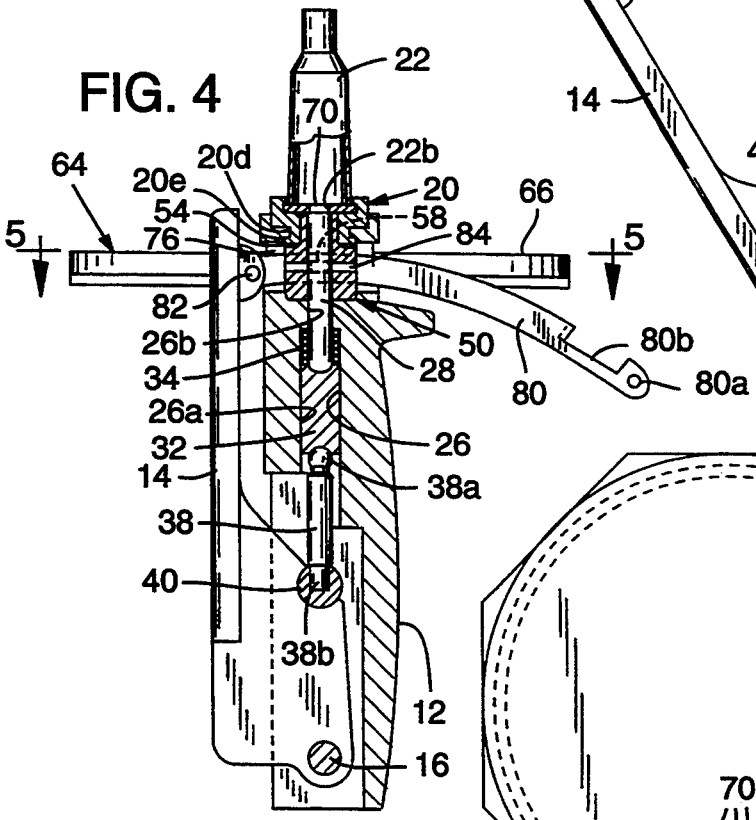
FIG. 4 is a view similar to FIG. 3, with the tool actuated to produce insertion of a primer into a cartridge case.

Referring to FIGS. 3 and 4, tool body 12 has an elongate bore 26 extending longitudinally therethrough. This bore has a first diameter portion **26*a* and a second portion 26*b*** of a smaller diameter.

An elongate plunger, or pin, 28 is slidably mounted in bore 26 for shifting longitudinally of the body between the positions illustrated in FIGS. 3 and 4, as will be described in greater detail below. The plunger has a diameter which allows it to extend slidably through bore portion **26*b***.

The lower end of plunger 28 is seated in a concavity in the top of a guide member 32 which is slidably mounted in bore portion **26*a*. A compression spring 34 is interposed between the top of guide member 32 and the top, necked down portion of bore section 26*a*, such that it urges guide member 32 and plunger 28 to their lowered position as illustrated in FIG. 3. The spring is compressed as the plunger and guide member are shifted upwardly to the position illustrated in FIG. 4**.

An elongate connecting, or operating, member 38 has a ball joint upper portion **38*a* which rests in a concave socket at the base of guide member 32, and has a necked down lower end portion 38***b*.

A cylindrical element 40 has a bore 40*a* extending into one side thereof which receives necked down portion 38*b* of connecting member 38. Handle 14 has a concave receiving region 44 formed therein intermediate its ends in which element 40 rotatably and loosely rests.

The interconnection and operation of parts thus described is such that when handle 14 is swung from a first position spaced from body 12 as illustrated in FIG. 3 toward its second position illustrated in FIG. 4, more closely adjacent body 12, connecting member 38 acts to push upwardly on guide member 32 against the urging of spring 34 and to drive plunger 28 upwardly toward cartridge case 22 held in case receiver 20.

If handle 14 is swung outwardly from body 12 to a third position spaced beyond the position shown in FIGS. 1 and 3 connecting member 38 in the plunger mechanism will fall from its connecting position for disassembly. In such condition the tool is inoperable.

Referring to FIG. 2, a pair of mirror image receiving parts are indicated generally at 50, 52. Since each is a mirror image of the other, only one will be described in detail.

Referring to receiver part 50, it includes a substantially rectangular block-like base portion 50*a* which extends substantially horizontally in the apparatus. Formed in its inwardly facing side, is a horizontal first passage portion 50*b* and a second, and somewhat larger, passage portion 50*c*. Portion 50*b* has a height slightly greater than the height of a primer to be used in the apparatus and a width slightly greater than half the width, or diameter, of such primer. Passage portion 50*c* has a greater height and width than portion 50*b*, for a purpose as will be described below. It should be recognized that passage portion 50*c* is aligned and joins with passage portion 50*b*.

Extending vertically through receiver part 50 is an arcuate opening portion 50*d* which has an upper lip portion 50*e* projecting above the top of base portion 50*a*. The arcuate opening portion 50*d* has a concave cross-sectional configuration slightly larger than one-half of the circular cross-section of a primer to be used in the apparatus. When the two receiver parts are mated in contiguous facing relationship their arcuate opening portions define therebetween a cylindrical primer receiving station 56 having a cross-sectional configuration slightly larger than a primer to be inserted in the apparatus.

Passage portions such as 50*b* in the mating receiver parts define a passage 58 having a cross-sectional configuration which allows a primer to slide easily therethrough into a primer receiving station 56.

Referring to receiver part 52, a slot 52*a* extends laterally therethrough, and is aligned with a similar slot extending through part 50 to allow slidable passage therethrough of a guard as will be described in greater detail below.

Figure 5:
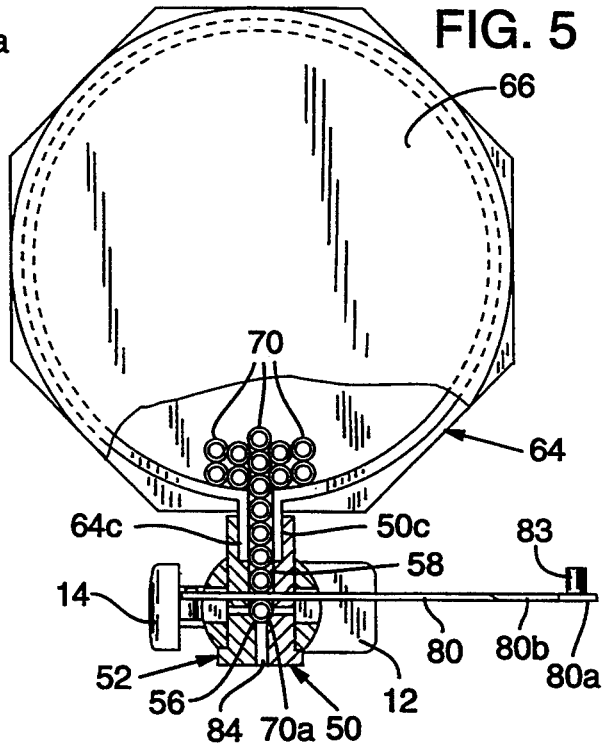
FIG. 5 is a view taken generally along the line 5—5 in FIG. 4.

When the receiver parts 50, 52 are joined in mating, facing contiguous relationship as illustrated in FIGS. 1 and 5, they define between them a primer receiving station 56 which is operable to receive and hold a single primer ready for insertion into a cartridge case. The upwardly projecting lip portions, such as 50*e*, together form a tube that extends upwardly into bore 20*c* of the cartridge case receiver.

The mating passage portions, such as indicated at 50*b*, together define a passage indicated generally at 58 for directing primers to the primer receiving station.

Referring to FIG. 2, body 12 has an opening 60 defined therein which is of a configuration to receive and frictionally hold the bottom flange 20*e* of the case holder and receiver parts 50, 52 in their mating facing contiguous relationship. A circular wavy spring 54 (see FIG. 2) slips over projections 50*e* and underlies flange 20*e* when the parts are assembled. This spring presses receiver parts 50, 52 against the bottom of opening 60 and presses flange 20*e* against the underside of lip 12*a* to assist in frictionally holding the parts together.

When in this position, the primer receiving station 56 defined between the two parts is aligned with plunger 28 and the plunger is shiftable along its longitudinal axis between the position illustrated in FIG. 3 adjacent the primer receiving station and the position illustrated in FIG. 4 passing upwardly through the primer receiving station.

Referring to FIGS. 1, 2 and 5, a primer reservoir is indicated generally at 64. The reservoir is a shallow cylindrical hopper having a base 64*a* and an upwardly extending circular lip 64*b*. A trough-shaped outlet 64*c* projects outwardly from one side of the reservoir. A plurality of concentric grooves are defined in base 64*a* to provide means for properly aligning primers in the reservoir as has been previously known. A cap 66 is removably mounted on the reservoir to hold primers therein.

As is best seen in FIG. 5, outlet trough 64*c* is configured to extend into and be frictionally held by mating passage portions, such as 50*c*, previously described in receiver parts 50, 52. Primers 70 having a circular disk-like configuration rest loosely in reservoir 64 and may slide outwardly in single file through trough 64*c* and passage 58 to primer receiving station 56. A primer 70*a* held in primer receiving station 56 is aligned between plunger 28 and the primer receiving port 22*b*.

A protective tab 72 projects outwardly from the top of body 12 over the path of trough 64*c* to protect against flash from an ignition at the cartridge case level effecting primers in the trough.

As is seen in FIG. 2, a pair of aligned openings 74, 76 extend through opposite sides of body 12 intersecting opening 60 into which parts 50, 52 are inserted. An elongate, arcuate, plate guard member 80 extends through openings 74, 76 and through slots as previously described at 52*a* in receiver parts 50, 52. As best seen in FIG. 5, guard 80 thus is positioned between primer receiving station 56 and primer passage 58.

In the assembled tool plunger 28 is mounted for shifting along a path, or line, in the direction of its longitudinal axis and the primer passage 58 extends outwardly from the primer receiving station 56 at a substantial angle relative to the path of the plunger. The guard 80 extends and is shiftable along a path in a plane disposed at a substantial angle relative to said passage. The plane of movement of the guard may parallel a plane in which the plunger moves.

One end of guard 80 is connected through a pivot pin 82 to an upper region of handle 14. The opposite end of guard 80 has a bore 80*a* extending therethrough in which a stop pin 83 is received and held. Stop pin 83 extends laterally of the guard. The stop pin 83 is positioned to abut, or catch on a portion of body 12 to inhibit withdrawing of the guard 80 beyond the position illustrated in FIG. 3. Not only does this prevent withdrawing of the guard beyond the selected position illustrated in FIG. 3, but it also serves to limit the outward movement of handle 14 away from body 12 under the urging of spring 34.

The assembly of the overall tool with the guard is such as to make the tool generally non-functional if the guard is removed. This provides a safety feature, such that a user will not be able to disengage the safety guard 80 and use the tool without it. Explaining further, plunger 28, spring 34, guide member 32, connecting member 38, and element 40 are all held in the tool only so long as handle 14 does not swing away from the tool body 12 much beyond the position illustrated in FIGS. 1 and 3. Since these parts are all loose within the mechanism, and only rest against each other in a compression mode, if the handle swings further away from the body than that shown the parts thus discussed will fall from the assembly and not be operable. The guard 80, pin 82 connecting one end of the guard to the handle and pin 83 at the opposite end of the guard inhibiting removal from the tool body hold the parts in operating position.

The distal end portion of guard 80 adjacent bore **80*a* has a reduced cross-sectional area 80*b*, also referred to herein as an opening. As is best illustrated in FIG. 3, this provides an opening between passage 58 and primer receiving station 56 such that a primer may move from the passage 58 into primer receiving station 56. However, once handle 14 begins its swinging movement toward body 12, remainder portions of guard 80 move into the space between primer receiving station 56 and passage 58 to isolate primer 70*a* from the remainder of the primers and thus shield the receiving station from the passage. Should primer 70*a* ignite, or fire, within the primer receiving station such action will be isolated by guard 80** from the other primers in the passage and reservoir and thus will not cause additional damage.

Gas relief orifices indicated generally at 84 are provided extending outwardly from the primer receiving station, such that if a primer does fire in this area gases produced thereby will be relieved to the exterior of the body of the tool.

Describing generally operation of the apparatus thus described, a plurality of primers are properly oriented in reservoir 64 and the reservoir is connected to the tool with its trough portion **64*c* aligned with the passage 58 in mating parts 50*a*, 50*b*. Initially handle 14 is swung to its first portion illustrated in FIG. 3 spaced from body 12, plunger 28 is in its lowered, or first, position with its top end below the primer receiving station, and guard 80 is positioned in a first position with its opening, or reduced portion, 80*b* aligned with the passage and primer receiving section. Thus, a primer may slide from reservoir 64, through passage 58, and into primer receiving section 56. A cartridge case to have a primer inserted therein is slid into the holding collar of case receiver 20 with its primer receiving port aligned with the primer receiving station 56 and plunger 28**.

The operator then begins to swing handle 14 toward body 12. As this occurs, guard 80 moves in the line of its arcuate length into the space between primer receiving station 56 and passage 58 to isolate primer **70*a* from remainder primers and shield the remainder of the primers therefrom. Plunger 28 is forced upwardly into and through the primer receiving station to carry 70*a* atop the plunger to be pressed into the primer receiving port in cartridge case 22**.

Once the primer has been pressed firmly into the cartridge case, handle 14 is allowed to swing back to its first position under the urging of spring 34, at which time the guard opens up the space between passage 58 and primer receiving station 56 to allow a new primer to move into the primer receiving station.

While a preferred embodiment of the invention has been described herein, it should be apparent to those skilled in the art that variations and modifications are possible without departing from the spirit of the invention.

We claim:

1. A tool for inserting a primer into a cartridge comprising, a cartridge case receiver operable to hold a cartridge case, a primer receiving station adjacent said cartridge case receiver for holding a single primer for insertion into a cartridge, a primer reservoir operable to hold a plurality of primers, a passage for directing primers from said reservoir to said primer receiving station, a plunger movable into said primer receiving station to press a primer from said station into a cartridge case, and a guard shiftable between a first position permitting a primer to pass from said passage to said receiving station and a second position shielding said receiving station from said passage.

2. The tool of claim 1, wherein said guard comprises a plate member mounted for shifting between said first and second positions.

3. The tool of claim 1, wherein said plunger is mounted for movement along a path extending through said station toward said cartridge receiver, said passage extends outwardly from said receiving station at a substantial angle relative to the path of the plunger and said guard is mounted for movement along a path disposed at a substantial angle relative to the passage.

4. The tool of claim 3, wherein said guard comprises a plate member having a planar portion disposed and movable in a plane substantially parallel to the path of the plunger and intermediate the path of the plunger and said passage.

5. The tool of claim 4, wherein said plate member has an opening defined therein which is aligned with said passage when the guard is in its first position permitting a primer to pass from said passage into said receiving station.

6. The tool of claim 1, which further comprises an operating handle swingable between first and second positions, means operatively connecting said handle to said plunger for shifting said plunger from a non-operating position outside said receiving station when said handle is in its first position to an operating position extending into said receiving station when the handle is swung to its second position, and said guard is operatively connected to said handle for shifting from its first position when said handle is in its first position to the guard's second position as the handle is swung to its second position.

7. The tool of claim 6, wherein said handle is mounted for swinging in an arc toward and away from said receiving station and said guard comprises an elongate arcuate member movable generally in the line of its arcuate length through a space between said receiving station and the passage.

8. The tool of claim 7, wherein said guard is pivotally connected adjacent one of its ends to said handle and comprises catch means adjacent its opposite end for inhibiting withdrawal of said guard completely from said space between said receiving station and the passage.

9. The tool of claim 1, wherein said primer receiving station is defined by a pair of mirror image receiver parts having facing arcuate openings therein which, when mated in contiguous relationship, define a cylindrical primer receiving region aligned with said plunger.

10. The tool of claim 9, wherein said receiver parts further comprise facing second openings extending at a substantial angle relative to the centers of curvature of said first-mentioned arcuate openings which second openings define said passage when the receiver parts are mated in contiguous relationship.

11. The tool of claim 9, wherein said receiver parts further comprise mating slots extending laterally therethrough adjacent said arcuate openings through which slots said guard may extend.

12. The tool of claim 11, which further comprises a tool body having a recess defined therein which receives and retains said receiver parts adjacent said cartridge case receiver, and an opening extends through said body aligned with said slots through which said guard extends.

13. A hand-held tool for inserting primers into a cartridge comprising an elongate body, a cartridge case receiver mounted adjacent one end of said body to hold a cartridge case for primer insertion, a primer receiving station on said body adjacent said case receiver for holding single primer prior to insertion into a cartridge case, a passage for directing primers to said primer receiving station, a plunger mounted for shifting longitudinally of said body into said primer receiving station to press a primer from said station into a cartridge case, and a guard shiftable between a first position permitting a primer to pass from said passage to said receiving station and a second position shielding said receiving station from said passage.

14. The tool of claim 13, which further comprises an elongate handle pivotally connected to said body for swinging between first and second positions, means operatively connecting said handle to said plunger for shifting said plunger between a non-operating position outside said receiving station when said handle is in its first position to an operating position extending into said receiving station when the handle is swung to its second position, and said guard is operatively connected to said handle for shifting from its first position when said handle is in its first position to the guard's second position as the handle is swung to its second position.

15. The tool of claim 14, wherein said handle is mounted for swinging in an arc toward and away from said receiving station and said guard comprises an elongate arcuate member movable generally in the line of its arcuate length between said receiving station and the passage.

16. The tool of claim 15, wherein said guard is pivotally connected adjacent one of its ends to said handle and comprises catch means adjacent its opposite end for inhibiting withdrawal of said guard completely from a position between said receiving station and the passage.

17. The tool of claim 13, wherein said primer receiving station is defined by a pair of mirror image receiver parts having facing arcuate openings formed therein which when mated in contiguous relationship define a cylindrical primer receiving region aligned with said plunger.

18. The tool of claim 17, wherein said receiver parts further comprise mating slots extending laterally therethrough adjacent said arcuate openings through which slots said guard may extend.

19. The tool of claim 18, wherein said receiver parts further comprise facing second openings extending at a substantial angle relative to the centers of curvature of said first-mentioned arcuate openings which second openings define said passage when the receiver parts are mated.

20. The tool of claim 18, wherein said tool body has a recess defined therein which receives and retains said receiver parts adjacent said cartridge case receiver, and an opening extends through said body aligned with said slots through which said guard extends.

21. The tool of claim 17, wherein a receiver part has a gas-release orifice extending therethrough.

22. The tool of claim 13, wherein said plunger is movable along a path extending through said station toward said cartridge case receiver, said passage extends outwardly from said station at a substantial angle relative to the path of the plunger, and said guard comprises a plate member mounted for movement along a path disposed at a substantial angle relative to the passage and the path of the plunger, said plate member having an opening defined therein which is aligned with said passage when the guard is in its first position permitting a primer to pass from said passage into said receiving station.

23. In a tool for inserting a primer into a cartridge case including a cartridge case receiver operable to hold a cartridge case, a primer receiving station for holding a single primer prior to insertion into a cartridge, and a passage for directing primers to the primer receiving station having an inner end communicating directly with said primer receiving station, a guard element comprising an elongate plate member mounted for sliding along a path into the region between the primer receiving station and the passage such that the guard element is shiftable between a first position permitting a primer to pass from the passage to the receiving station and a second position interposed between the primer receiving station and the passage, thereby shielding the receiving station from the passage.

24. A tool for inserting primers into a cartridge comprising:

a tool body, a cartridge case receiver operable to hold a cartridge case, a primer receiving station adjacent said cartridge case receiver for holding a single primer for insertion into a cartridge, a passage for directing primers to said primer receiving station, plunger mechanism including a plunger movable into said primer receiving station to press a primer from said station into a cartridge case, said plunger mechanism being removably mounted in the tool body, a guard shiftable between a first position permitting a primer to pass from said passage to said receiving station and a second position shielding said receiving station from said passage, and an operating handle pivotally connected to said body swingable between a first position spaced outwardly at an angle from said body and a second position nearer said body, said handle being operatively connected to said plunger mechanism for shifting said plunger between a non-operating position spaced from said receiving station when said handle is in its first position and an operating position extending into said receiving station when the handle is swung into its second position, and said guard is operatively connected to said handle for shifting from its first position when said handle is in its first position to the guard's second position as the handle is swung to its second position.

25. The tool of claim 24, wherein said guard comprises an elongate member movable generally in the line of its length through a space between said receiving station and the passage.

26. The tool of claim 25, wherein said guard is pivotally connected adjacent one of its ends to said handle and comprises stop means adjacent its opposite end for inhibiting withdrawal of said guard completely from said space between said receiving station and the passage.

27. The tool of claim 26, wherein said handle is swingable outwardly from said body a distance beyond said first position to a third position, said plunger mechanism comprises a connecting member loosely mounted between said handle and plunger which is retained in place between the handle and plunger when the handle is in its first or second position or a position therebetween, but will fall from an interconnection when the handle is swung to its third position, and said guard and stop means inhibit swinging of said handle outwardly to said third position.

* * * * *

UNITED STATES PATENT AND TRADEMARK OFFICE

CERTIFICATE OF CORRECTION

PATENT NO. : 5,435,223

DATED : July 25, 1995

INVENTOR(S) : Fred B. Blodgett; Steven R. Shields; Alan D. Schufeldt

It is certified that error appears in the above-identified patent and that said Letters Patent is hereby corrected as shown below:

On the title page, item [56]:

In the References Cited - U.S. Patent Documents, the Lee reference Patent No. 3,555,959, the year of the patent should be changed to -- 1/1971 --.

In the References Cited - U.S. Patent Documents, the following references should be added to the list:

| | | | | |
|---|---|---|---|---|
| -- | 3,292,293 | 12/1966 | Chiasera et al. | Class 86/Sub-Class 38 |
| | 3,320,848 | 5/1967 | Ponsness | Class 86/Sub-Class 38 |
| | 4,526,084 | 7/1985 | David et al. | Class 86/Sub-Class 38 |
| | 4,331,063 | 5/1982 | Schaenzer | Class 86/Sub-Class 36 -- |

Signed and Sealed this

Seventeenth Day of October, 1995

*Attest:*

Bruce Lehman

BRUCE LEHMAN

*Attesting Officer*

*Commissioner of Patents and Trademarks*